US005123544A

United States Patent [19]

Hannecke

[11] Patent Number: 5,123,544

[45] Date of Patent: Jun. 23, 1992

[54] ARRANGEMENTS FOR DISPLAYING FLAT OBJECTS

[75] Inventor: Wolf-Dietrich Hannecke, Northeim, Fed. Rep. of Germany

[73] Assignee: Wolf-Dietrich Hannecke Kunststofftechnik, Northeim, Fed. Rep. of Germany

[21] Appl. No.: 573,546

[22] Filed: Aug. 27, 1990

[30] Foreign Application Priority Data

Sep. 12, 1989 [DE] Fed. Rep. of Germany ... 8910867[U]

[51] Int. Cl.[5] ..... A47F 7/00

[52] U.S. Cl. ..... 211/51; 211/41

[58] Field of Search ..... 211/50, 51, 40, 41

[56] References Cited

U.S. PATENT DOCUMENTS

| | | | |
|---|---|---|---|
| 450,747 | 4/1891 | Nosker | 211/51 |
| 2,407,119 | 9/1946 | Weston | 211/50 |
| 2,488,262 | 11/1949 | Bengelsdorf | 211/51 |
| 2,912,113 | 11/1959 | Durec | 211/51 |
| 3,892,309 | 7/1975 | Coffey et al. | 211/51 X |
| 4,585,128 | 4/1986 | Hannecke | 211/51 |
| 4,753,369 | 6/1988 | Morrison | 211/51 X |

FOREIGN PATENT DOCUMENTS

| | | | |
|---|---|---|---|
| 3311975 | 10/1984 | Fed. Rep. of Germany | 211/51 |
| 0016116 | 8/1905 | United Kingdom | 211/50 |
| 0823070 | 11/1959 | United Kingdom | 211/50 |

*Primary Examiner*—David M. Purol
*Assistant Examiner*—Sarah A. Lechok
*Attorney, Agent, or Firm*—Michael J. Striker

[57] ABSTRACT

An arrangement for displaying flat bendable objects, especially sheet shaped record carriers comprises a horizontal bottom plate, at least two upwardly open elongated compartments for receiving of objects, two substantially vertical curved side walls extending so that they approach one another to define in the compartments two withdrawal openings located near one another at an outer edge of the bottom plate. The side walls have longitudinal portions which together form a one piece wall portion. The side walls also have rear extensions which extend rearwardly of the wall portion and form inner side walls. The inner side walls are turnable about axes extending perpendicularly to the bottom plate and are spring loaded in direction toward the compartments.

14 Claims, 1 Drawing Sheet

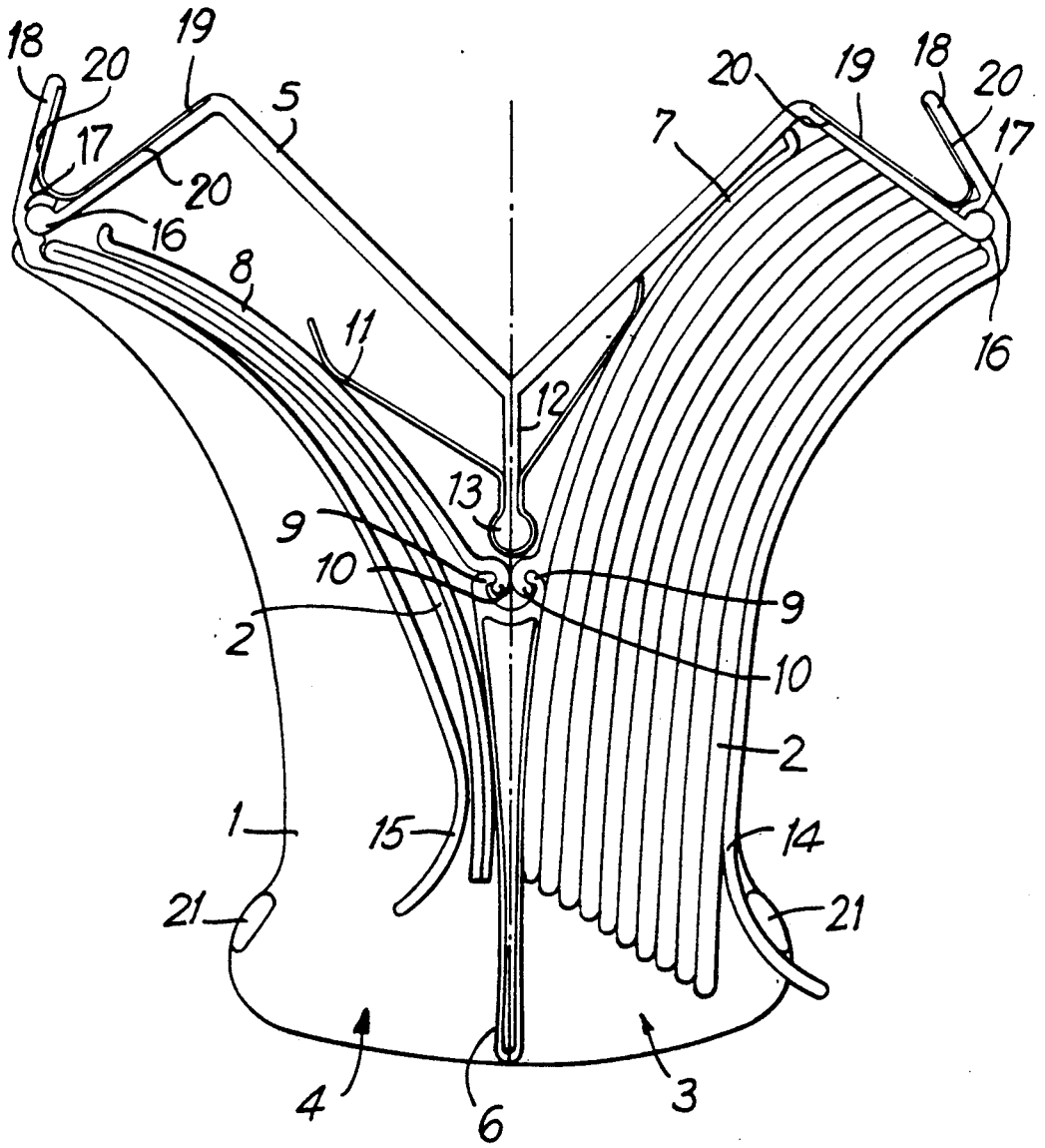
18
20
19
5
17
20
16
8
11
12
13
9
10
2
1
15
21
4
6
3
7
20
19
18
20
17
16
9
10
2
14
21

ARRANGEMENTS FOR DISPLAYING FLAT OBJECTS

BACKGROUND OF THE INVENTION

The present invention relates to an arrangement for displaying flat, bendable objects, particularly sheet shaped record carriers.

Arrangements of the above mentioned general type are known in the art. One of such arrangements is disclosed for example in the German document DE-GM 8,225,277. In this arrangement side walls which limit the compartments are arranged stationarily on the bottom plate and in particular formed of one piece with one another. The curvature of the side walls must increase the standing strength of the objects accommodated in the compartments, so that always an efficient presentation of the objects is possible. For maintaining the position of the objects which is convenient for displaying in the case of significantly emptied compartments, a pressure spring formed as a sheet spring is provided in each compartment. Its free ends abut against the objects. It has been shown that the maintaining of the position of the objects which is advantageous for displaying, especially with significantly emptied compartment and also in the case of stiff objects, is not sufficient when stationary side walls and limited abutment of the sheets springs in the compartments are used. The remaining position of the side walls cannot be completely sufficient to provide in such arrangement a specially important efficient presentation of objects with good taste.

SUMMARY OF THE INVENTION

Accordingly, it is an object of the present invention to provide a arrangement for displaying flat objects which avoids the disadvantages of the prior art.

More particularly, it is an object of the present invention to provide an arrangement of the above mentioned type in which the optimal display position of the bendable objects in the compartments can be achieved in the event of varying filling of the compartment with a simple construction and mounting, so as to provide presentation of different objects, for example newspapers and magazines of all types, which is important for advertising and sales. This is especially important when a great number of such arrangements are used in sale spaces on suitable stand or wall surfaces, such as for example in shelves, posts, etc.

In keeping with these objects and with others which will become apparent hereinafter, one feature of the present invention resides, briefly stated, in that inner side walls are provided in the arrangement and turnably supported at their rear ends on a wall portion formed by longitudinal portions of the side walls, so that the inner side walls are turnable about axes extending perpendicularly to a bottom plate and spring loaded in direction toward compartments of the arrangement.

In contrast to the above described known arrangement, the turnable portions of the inner side walls are spring loaded to automatically abut against the objects to be displayed. Thereby, a reliable maintaining of the desired optimal position of the objects is achieved for the event of maximum filling of the compartments and minimum filling of the compartments. Since the spring loading is performed over the long surface of the turnable inner side walls and not as in the known arrangement at the end of the pressure spring arranged in the compartment, the pressing action is distributed over a great surface of the object and contributes to maintaining of the optimal position of the object. Since the objects are no longer loaded directly by a spring, the pressing force of the spring loaded inner side walls can be selected high for supporting stiff materials in the compartment without disadvantageous or damaging loading of the objects. The height of the side walls above the bottom plate can be selected for respective display purpose, as well as the shape, thickness and pressure of the spring loading of the inner side walls.

In accordance with another feature of the present invention, the turning axes are formed by inwardly curved formations on the wall portion, and the side walls are provided with complementary outwardly curved formations pivotally arranged on the formations of the wall portions. This construction is especially simple for producing the parts to be used, namely of synthetic plastic material and their mounting as well. The wall portion, in some cases together with the bottom plate, can be simply molded together with the formations which form the turning axes, and the side walls with their formations can be formed the same way. Then the side walls can be simply connected with the wall portion and particularly by simple fitting or plugging. By selecting the respective position of the formations relative to one another, a reliable holding of the side walls on the rear bearing end of the wall portion can be obtained.

Another feature of the present invention is that an expanding joint sheet spring is provided for spring loading of the turnable inner side walls. The free ends of the sheet springs abut against the side walls. The spring is held on a projection of a stationary rear wall. This feature provides for a simple construction and mounting, and particularly mounting of the spring required for spring loading of the turnable inner side walls. The design, thickness and pressure of the expanding sheet spring can be selected in accordance with the respective application. The holding of the expanding sheet spring between the inner side walls outside the compartment provides for high pressing force with optimal design of the sheet spring. The holding of the sheet spring centrally on the projection of the stationary rear wall leads to a simple construction, especially during molding of synthetic plastic material.

In accordance with another feature of the present invention, the sheet spring is snappingly arranged on a front thickened portion of the projection. This provides for an especially simple and advantageous manufacture and mounting.

In accordance with a further feature of the present invention, the side walls of the compartments are turnably supported with their rear ends on stationary axes extending perpendicularly to the bottom plate from turning from the outer position and spring loaded in direction toward the interior of the compartments. This provides for an especially advantageous and efficient solution. This design provides for a significant advantage in that the side walls can adjust to the filling degree of the compartments, and it is especially advantageous that the spring loading is performed in direction toward the objects. In cooperation with the turnable inner side walls, a best possible maintaining of the position of the objects in the compartment is provided in each filling degree. The spring loading of the outer side walls can be selected in accordance with respective applications. By the selectable curvature both of the inner side walls and the outer side walls with their turnability, the best possible position for the objects to be displayed in the compartments is maintained. The pressing action by the outer side walls is performed practically over their whole surface, so that an excessive loading of the objects to be presented is completely avoided. The outer side walls are slightly turned against the abutment limit outwardly for filling the compartments and are always under the desired pressure relative to the content of the compartment.

For manufacture and mounting the region of the turnable outer side walls, it is especially advantageous when the turning axes for the outer side walls are formed by vertical pin-shaped formations on the side ends of the rear wall, and each outer side wall has a complementary recess snappingly fitted on the formation in a turnable manner. The stationary rear wall can be easily molded together with the bottom place and the pin shaped formations, especially in synthetic plastic processes. The same is true for the formations of the outer side walls with the bearing recesses and the mounting for the snapping locking in the bearing region.

An especially simple manufacture is achieved when the side walls are provided at their rear ends with tongue-like or strip-like extensions extending beyond their turning axes. A pressure spring is arranged between the rear wall and the respective extension. The design of the spring and its spring force can be adjusted to the respective applications.

For the manufacture, the mounting and the operation it is advantageous when the pressure spring is formed as an expending sheet spring with the end abutting against the extension of the side wall on the one hand and against the rear surface of the rear wall on the other hand, and retained on the extension and on the rear wall.

The one-piece wall portion formed by the portions of the side walls can be formed as an upwardly open hollow body of a transparent synthetic material. It has been shown in practice that it is advantageous when such arrangements and especially multi-compartment arrangements are made so that their content can be identified by suitable paint marking or lettering. This can be achieved with the open transparent hollow body of the wall portion in a simple and efficient manner in that the paint marking or lettering by paint or letter sheet or the like can be inserted into the hollow body.

For this purpose, on the one hand, and for especially advantageous design of the compartments with their withdrawal openings, the wall portion can be wedge-shaped with an apex directed toward the withdrawal openings.

In accordance with a further feature of the present invention, an abutment projection upwardly extending from the bottom plate is provided for limiting the outer position of each side wall. This provides for a simple manufacture and at the same time efficient limiting of the outer side walls, especially when the bottom plate is composed of synthetic plastic material and the abutment projection can be molded on it simultaneously.

In accordance with another feature of the present invention the rear wall can be M-shaped on a plan view, the sheet spring for the inner side wall can be arranged on a projection which forms an extension of the central apex of the rear wall and its leg ends can be formed as pin-shaped formations, and the sheet springs for the outer side walls can be held in a recess of the outer leg of the rear wall and the extension of the outer side wall. This construction is advantageous for manufacturing and mounting and also has an advantageous structure for the presentation. The M-shaped rear wall permits stacking of the arrangements in a row with one another, with minimum width of the individual arrangements and significant increase of the visible surface observed by eye of observers.

All components of the arrangement with the exception of sheet springs can be composed of transparent synthetic plastic material. Therefore, a complete observation of the objects is possible and also from its rear side. At the front side of the objects facing toward an observer, exclusively transparent synthetic plastic material is provided so that the view is not obstructed in any way. The non-transparent sheet springs are arranged outside of the presentation region and more particularly they are arranged on the one hand in the interior between the turnable inner side walls and on the other hand at the rear end outside the compartment on the outer side walls.

The arrangement can be mounted by suitable mounting means on poles, shelves, or walls in a simple manner, especially on the rear end of the stationary rear wall.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single FIGURE of the drawings is a schematic plan view showing an arrangement for displaying flat objects in accordance with the present invention.

DESCRIPTION OF A PREFERRED EMBODIMENT

An arrangement for displaying flat objects in accordance with the present invention has a horizontal bottom plate 1 with an outer contour corresponding to the course of the compartment and the structural elements to be described. Two longitudinally extending compartments 3 and 4 are provided on the horizontal bottom plate 1. The compartments are open upwardly and serve for receiving of objects 2. The compartments 3 and 4 are limited by vertical side walls which are arranged on the bottom plate and curved in an arcuate shape in the same direction as will be described hereinbelow.

The compartments end in the region of the outer edge of the bottom plate, or downwardly in the drawings, in a withdrawal opening. The side walls of two compartments extend so that they approach one another in direction toward the withdrawal opening. Therefore, the compartments in their longitudinal extension enclose an angle and their withdrawal openings are arranged near one another as can be seen from the drawings. A rear wall 5 is arranged on the horizontal bottom plate 1 at the rear end. The rear wall 5 has an M-shape.

The inner side walls of the compartments 3 and 4, which are associated with one another, are united to form a common one-piece wall portion 6. This wall portion forms the central partition between both withdrawal openings of the compartments 3 and 4. The wall portion 6 is formed as an upwardly open hollow body of a transparent synthetic plastic material. It is wedge-shaped and has an apex directed toward the withdrawal openings as shown in the drawings.

Inner side walls 7 and 8 which remain rearwardly of the wall portion 6 are turnably supported on the rear end of the one piece wall portion 8 for turning about a stationary axis perpendicular to the bottom plate 1. They are spring-loaded in direction toward the interior of the compartments. The turning axes are formed by inwardly curved formations 9. The side walls 7 and 8 have complementary outwardly curved formations 10 which are pivotally mounted on the associated formations 9 of the wall portion 6. The shape and position of the formations 9 and 10 can be selected so that the inwardly curved portions of the formations 10 of the inner side walls 7 and 8 abut against one another to secure the bearing in this position. During mounting the inner side walls 7 and 8 with their formations 10 are inserted onto the formations 9 from above.

The spring loading of the turnable inner side walls 7 and 8 in direction toward the interior of the compartments is performed by a spreading joint sheet spring 11. Its free ends abut against the side walls 7 and 8. The sheet spring 11 is held on a projection 12 of the stationary vertical rear wall 5, extending centrally between the side walls 7 and 8. The sheet spring 11 is snappingly fitted centrally on a front thickening of the projection 12.

As can be seen from the drawing, the compartments 3 and 4 are provided with outer side walls 14 and 15. The outer side walls are supported at their rear ends turnably about a stationary axis extending perpendicularly to the bottom plate. They are turnable from an abutment position shown in the right half of the drawing and in direction toward the interior of the compartments. The turning axes for the outer side walls 14 and 15 are formed by vertical pin-shaped formations 16 on the side ends of the rear wall 5. Each outer side wall 14 and 15 is snappingly fitted on the formations 16 for the turning fixation by complementary recesses 17, and retained in a turnable manner.

The spring loading of the outer side walls 14 and is performed in the following manner: the outer side walls 14 and 15 are extended at their rear ends over their turning axes 16 and 17 to form extensions 18. A pressure spring 19 is arranged between the rear wall 5 and the extension 18 and formed as an expanding sheet spring. Its ends abut against the extension 18 on the one hand and against the rear surface of the rear wall 5 on the other hand and held there. For holding, simple recess 20 can be provided in the rear surface of the rear wall 5 and in the extension 18.

An abutment projection 21 is provided for limiting the outer position of the outer side walls 14 and 15, in which position the respective side wall abuts against the respective abutment projection as shown in the right half of the drawings. The abutment projections 21 extend upwardly and are formed on the bottom plate 1.

As can be seen from the drawings, the rear wall 5 is arranged stationary on the bottom plate 1 and has M-shape on the plan view. It has the projection 12, 13 which carries the sheet spring 11 for the inner side walls 7 and 8 and forms an extension of the central apex of the rear wall. The pin-shaped formation 13 forms a turning axis. The sheet springs 19 for the outer side walls 14 and 15 are held on the outer legs of the rear wall 5.

All components of the arrangement, with the exception of the sheet springs 11 and 19, are preferably formed of a transparent synthetic plastic material. The height of the structural elements, or in other words their extension perpendicularly to the bottom plate 1 can correspond to the respective application and be selected respectively. In particular, the height of the wall portion 6, the side walls 7 and 8, the side walls 14 and 15, and the rear wall 5 can be selected to extend over the whole height of the objects to be displayed. The spring properties and thereby also the width of the sheet springs 11 and 19, with the height extending perpendicularly to the drawings, are selected in accordance with the respective applications. All sizes for many applications can be selected for the finished objects to be handled for permitting displaying of all other flat and bendable objects in the desired manner as well as possible.

The free ends of the outer side walls 14 and 15 can curved outwardly as shown in the drawings to contribute to the adjustment. Also, the free ends of the inner walls 7 and 8 can be provided with bent portions shown in the drawings, for forming an abutment.

If it is sufficient for the objects to be displayed, it is possible to form the outer side walls of the compartments 3 and 4 stationarily as the rear wall 5, and to design only the inner side walls 7 and 8 turnably with spring loading as shown in the drawing. With corresponding dimensioning, for the shown embodiment and for the first described embodiment, with fixed outer side walls, the same components can be used with respect to the turnability of the inner side walls, this simplifies and facilitates manufacture and mounting.

Finally, for certain applications an embodiment is possible in which the inner and outer side walls have arcuate curvatures opposite to those shown in the embodiment, in other words, convex arcuate curvatures.

It will be understood that each of the elements described above, or two or more together, may also find a useful application in other types of constructions differing from the types described above.

While the invention has been illustrated and described as embodied in an arrangement for displaying of flat bendable objects, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters patent is set forth in the appended claims.

I claim:

1. (replaces the allowable claim 13) An arrangement for displaying flat bendable objects, especially sheet shaped record carriers, comprising a horizontal bottom plate; at least two upwardly open elongated compartments for receiving of objects; two substantially vertical curved side walls extending so that they approach one another to define in said compartments two withdrawal openings located near one another at an outer edge of said bottom plate, said side walls having longitudinal portions which together form a one piece wall portion, said side walls having rear extensions which extend rearwardly of said wall portion and form inner side walls, said inner side walls being turable about axes extending perpendicularly to said bottom plate and being spring loaded in direction toward said compartments; turnable outer side walls which limit outwardly said compartments and have rear ends supported on axes extending perpendicularly to said bottom plate for turning from an outer position and are spring loaded in direction toward the interior of said compartments; and an abutment projection extending upwardly from said bottom plate and limiting an outer position of a respective one of said side walls.

2. An arrangement as defined in claim 1, wherein said side walls are arcuately curved in a same direction.

3. An arrangement as defined in claim 1, wherein said turning axes are formed each as a curved formation on said wall portion, each of said inner side walls having a complementary outwardly curved formation pivotally connected with said curved formation of said wall portion.

4. An arrangement as defined in claim 1; and further comprising means for spring loading said inner side walls and including an expanding joint sheet spring with free ends abutting against said inner side walls.

5. An arrangement as defined in claim 4; and further comprising a stationary vertical rear wall arranged on said bottom plate, said rear wall has a projection located centrally between said inner side walls and holding said sheet spring.

6. An arrangement as defined in claim 5, wherein said projection has a front thickened portion, said sheet spring being snappingly arranged on said front thickened portion of said projection.

7. An arrangement as defined in claim 1; and further comprising a rear wall provided on said bottom plate, said turning axes for said outer side walls being formed as pin-shaped formations arranged on lateral ends of said rear wall, each of said outer side walls having a complementary recess with which it is snappingly placed on said pin-shaped formation and turnably held on the same.

8. An arrangement as defined in claim 1, wherein each of said outer side walls is extended at its rear end over a respective one of said turning axes, and further comprising a pressure spring arranged between said rear walls and said extension for spring loading a respective one of said outer side walls.

9. An arrangement as defined in claim 8, wherein said pressure spring is formed as an expanding sheet spring with one end abutting against said extension and another end abutting against a rear surface of said rear wall.

10. An arrangement as defined in claim 1, wherein said one piece wall portion is formed as an upwardly open hollow body of a transparent synthetic plastic material.

11. An arrangement as defined in claim 1, wherein said wall portion is wedge-shaped and has an apex directed toward said withdrawal openings.

12. An arrangement as defined in claim 1; and further comprising a rear wall extending substantially perpendicularly to said bottom plate and having M-shape on a plan view; and a sheet spring for spring loading said inner side walls, said rear wall having a central apex provided with an extension which forms a projection with a pin-shaped formation; and a sheet spring for spring loading said inner side walls and arranged on said pin-shaped formation which forms a turning axis.

13. An arrangement as defined in claim 12; and further comprising a sheet spring for spring loading a respective one of said outer side walls, said sheet spring being held in a recess of an outer leg of said rear wall and on an extension of a respective one of said outer side walls.

14. An arrangement as defined in claim 1, wherein said bottom plate and all of said walls are composed of a transparent synthetic plastic material.

* * * * *